United States Patent [19]

Ingham

[11] 3,960,116

[45] June 1, 1976

[54] ROTARY ENGINE

[76] Inventor: Lawrence Allister Ingham, Box 112, Lanigan, Saskatchewan, Canada

[22] Filed: Sept. 16, 1974

[21] Appl. No.: 506,202

[52] U.S. Cl. ..... 123/8.45; 418/111; 418/137; 418/267

[51] Int. Cl.[2] ..... F02B 53/00

[58] Field of Search ..... 123/8.45; 418/111, 137, 418/266, 267

[56] References Cited

UNITED STATES PATENTS

| | | | |
|---|---|---|---|
| 1,186,114 | 6/1916 | Meyer et al. | 418/266 |
| 1,343,115 | 6/1920 | Current | 418/266 X |
| 1,565,449 | 12/1925 | Higbee | 418/111 X |
| 1,909,880 | 5/1933 | Meyer | 123/8.41 |
| 2,274,232 | 2/1942 | Boyer | 418/111 X |
| 2,878,793 | 3/1959 | Birk | 418/266 X |
| 3,765,379 | 10/1973 | Thomas | 123/8.45 |

FOREIGN PATENTS OR APPLICATIONS

| | | | |
|---|---|---|---|
| 661,868 | 3/1929 | France | 418/266 |
| 1,365,696 | 5/1964 | France | 123/8.45 |
| 41,101 | 7/1958 | Poland | 418/266 |

*Primary Examiner*—Carlton R. Croyle
*Assistant Examiner*—Michael Koczo, Jr.
*Attorney, Agent, or Firm*—Stanley G. Ade

[57] ABSTRACT

An annular ring is closed on each side by a side plate secured thereto thus forming a cylindrical chamber or casing. A rotor is mounted on a shaft which is supported axially by the side plates, the rotor being within the chamber. A plurality of pistons are mounted for pivotal action around the periphery of the rotor and are in sealing engagement with the side plates. These pistons have a transverse contact line engaging the inner surface of the annular ring. This inner surface is contoured so that a compression lobe and a power lobe are formed and as the rotor rotates, fuel and air is drawn in through an intake in the wall of the ring, is compressed by one of the pistons, and then firing takes place so that expansion occurs as the piston is passing through the power lobe with the residual gases being exhausted through the exhaust port. A complete cycle occurs through 360° rotation so that if four pistons are provided, then four power pulses are provided on each revolution and is thus equivalent to a conventional eight-cylinder four-stroke engine with regard to power strokes per revolution. Alternatively, air only may be compressed with fuel being injected so that the engine acts as a compression ignition engine.

19 Claims, 11 Drawing Figures

ROTARY ENGINE

BACKGROUND OF THE INVENTION

This invention relates to new and useful improvements in rotary engines. Many attempts have been made to provide rotary engines which eliminate reciprocating motion. Many of these are extremely involved and the majority of such engines suffer from difficulty in sealing the various parts so that the compression and expansion portions of the cycle do not suffer from excessive losses.

Another disadvantage of conventional engines is that it is not possible to vary the ratio of the compression volume to the expansion volume portion of the cycle making the use of such engines rather inflexible.

SUMMARY OF THE INVENTION

The present invention overcomes these disadvantages by providing a rotary engine which includes a rotor carrying a plurality of pistons around the periphery thereof. These pistons include novel means for maintaining the desired seal between the pistons and the side plates and the rotor includes novel seals maintaining the sealing relationship between the rotor and the side plates and the rotor and the pistons.

One of the principal objects of the invention is to provide a rotary engine where all motion is rotary and eliminating all reciprocating action and further, to provide a design where all partial rotary motions are exactly cancelled by equal and opposite partial rotary motions.

Another object of the invention is to provide a device of the character herewithin described which enables a high power to weight ratio and a high power to size ratio to be attained.

A still further object of the invention is to provide a rotary engine which gives a very smooth output torque and, with four piston components, giving an output torque similar to an eight-cylinder four-stroke engine.

Still another object of the invention is to provide a device of the character herewithin described which includes means to have the compression volume of the cycle different from the expansion volume. In this design the compression ratio and the expansion ratio can differ from each other and thus efficiency can be improved without suffering the disadvantages of detonation and polution problems. For example a compression ratio of 8 to 1 could be used while (in the same engine) the expansion ratio could be 12 to 1.

A yet further object of the invention is to provide an engine where the volume of the combustion chamber during exhaust and intake stroke can be reduced to a lower value than during compression and power strokes. Thus volumetric effeciency can be improved and the mixing of exhaust gases with intake charge can be reduced.

A further object of the invention is to provide a device of the character herewithin described which is simple in construction, economical in manufacture and otherwise well suited to the purpose of which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
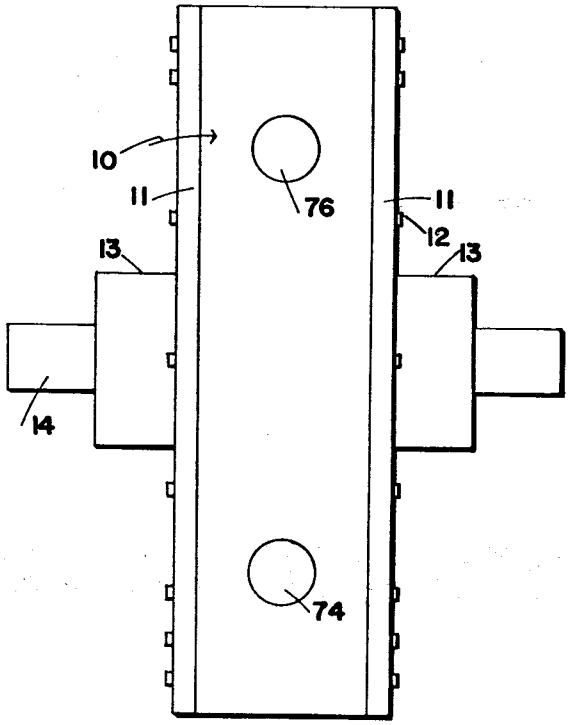
FIG. 1 is a top elevation of the assembled engine with the normal accessories removed for clarity.

Proceeding therefore to describe the invention in detail, reference should be made to the accompanying drawings in which reference character 10 illustrates an annular ring having a pair of spaced and parallel side plates 11 secured thereto by means of bolt assemblies 12 either extending through both side plates and the ring 10 or screw threadably engaging into the ring 10, depending upon design.

The side plates 11 are in sealing relationship with the sides of the ring 10 and these side plates are provided with bearing bosses 13 one upon each side thereof situated axially of the side plates.

A main shaft 14 is bearably supported within these bearing bosses 13 and extends through the substantially cylindrical chamber collectively designated 15 defined by the side plates and the annular ring 10.

Although the external configuration of the annular ring 10 and the side plates 11 is circular, nevertheless it will be appeciated that this can be any convenient shape as desired.

The cylindrical chamber 15 within the casing formed by the side plates 11 and the annular ring 10, is provided with an enlarged portion 16 and a further enlarged portion 17 situated diametrically opposite to the portion 16. These portions are formed by two arcs of a circle 16A and 17A to form a compression lobe 16B and an expansion lobe 17B. These arcs 16A and 17A are connected to the main circle defined by the line 18, with tangent lines. However, this inner-shape is not critical and can be altered as desired depending upon design parameters. The size and shape of the lobes affects the compression and expansion ratios of the engine.

A rotor collectively designated 19 (FIG. 5) is secured to the main shaft 14 by means of a key 20 in the conventional manner so that this rotor is situated within the chamber 15 and rotates therewithin.

Figure 5:
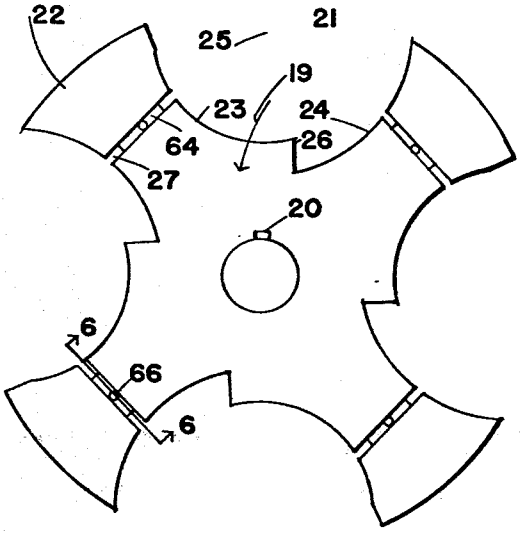
FIG. 5 is a front elevation of the rotor per se with the seals removed.

The rotor is provided with cut-out portions 21 thus defining rotor arms 22 as shown in FIG. 5 and these cut-out portions 21 include a radius portion 23 and a further radius portion 24 and it will be observed that although these radii are formed from a common locus 25, nevertheless radius 24 is larger than radius 23 thus providing a step 26 therebetween.

The arms 22 of the rotor 19 are substantially rectangular when viewed in cross section and are provided with grooves 27 extending therearound and intermediate the ends thereof, the purpose of which will hereinafter be described.

Figure 2:
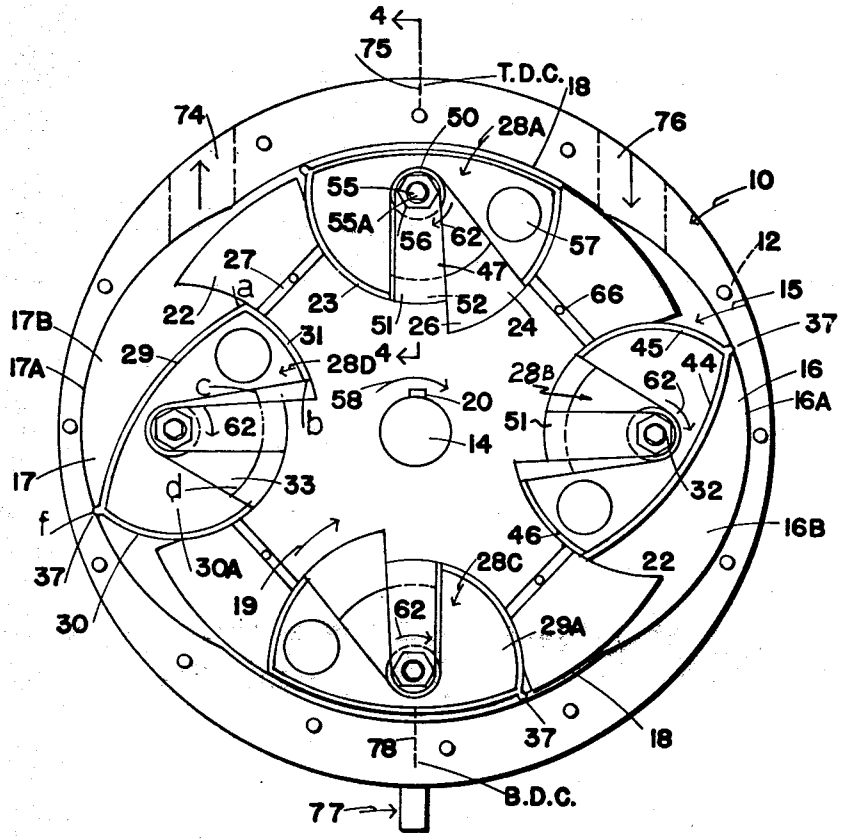
FIG. 2 is a view at right angles to FIG. 1, but with one of the side plates removed showing the interior of the engine.

Secured within the cut-out portions 21 of the rotor 19 are piston components collectively designated 28 and specifically designated 28A, 28B, 28C and 28D in FIG. 2.

Each piston component consists of a pair of outer plates 29A and 29B which are similar in configuration except that one is left-handed and the other is right-handed.

Figure 7:
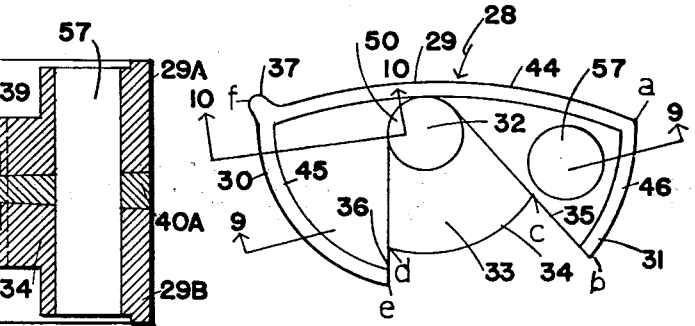
FIG. 7 is a front elevation of one of the piston components.

The configuration of the plates in side elevation is shown in FIG. 7 and consists of an arcuately curved surface 29 extending between points A and F, a curved surface 30 extending between points F and E, and a further curved surface 31 extending between points A and B, the radii of portions 30 and 31 extending from a common locus 32 but with the radius 31 being greater than the radius 30.

The segment 33 between points E and B is cut back and the outer surface of this segment is curved as at 34, the radius of this curve also extending from locus 32.

Figure 8:
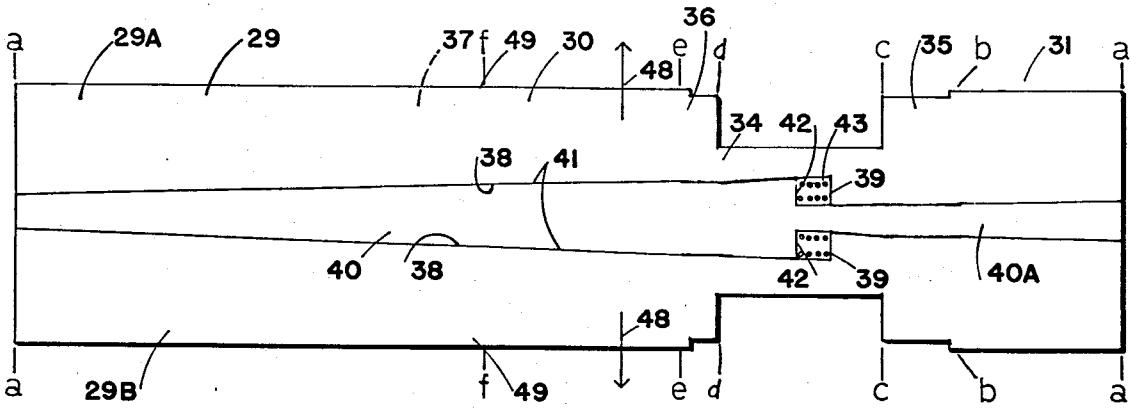
FIG. 8 is an extended view of the outer surface of the piston, such view being at all times perpendicular to the surface.

FIG. 8 shows the profile of the piston component with the corresponding points A through F clearly located and in this regard, it should be observed that points C and D are defined as extremities of the radius curve 34 where it meets the shoulders 35 and 36 extending from points B and E respectively.

At point F there is located a transversely extending contact strip 37 which is rounded in profile to form a sealing line where the pistons engage the inner surface of the chamber 15 as shown in FIG. 2.

Figure 9:
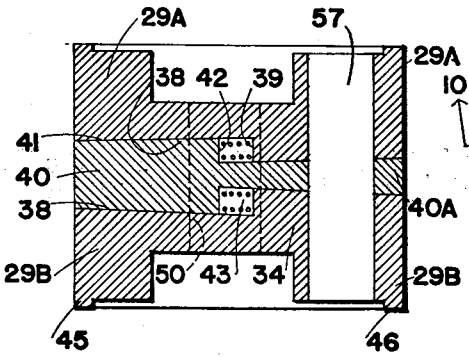
FIG. 9 is a cross sectional view substantially along the line 9—9 of FIG. 7.
Figure 10:
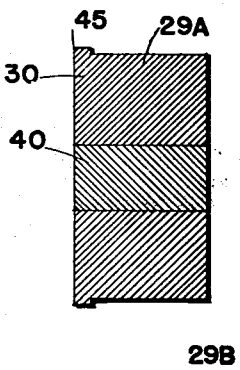
FIG. 10 is a cross sectional view substantially along the line 10—10 of FIG. 7.

The inner surfaces of the outer plates 29A and 29B are inclined as illustrated by reference character 38 and situated on these inner surfaces is a shoulder 39 shown in FIGS. 8 and 9.

Situated between the outer plates 29A and 29B is an inner plate 40 which is provided with complementary inclined outer surfaces 41 so that when the inner plate is in engagement between the outer plates, it exerts a wedging action as clearly illustrated. This inner plate is also provided with shoulders 42 where the thickness of the inner plate decreases, this decreased thickness portion is illustrated by reference character 40A in FIGS. 8 and 9.

Compression springs 43 are situated upon each side of the reduced thickness portion 40A and engage the shoulders 42 of the inner plate and react against the shoulders 39 of the outer plates thus forcing the inner plate 40 into wedging relationship with the outer plates so that these outer plates are urged outwardly in the direction of arrows 48 (see FIG. 8) but due to the configuration of the inner surfaces of the outer plates and the outer surfaces of the inner plate, the outer sides 49 of the outer plates remain substantially spaced and parallel with one another. This wedging action caused by the springs 43, maintains the outer surfaces 49 of the outer plates in sealing relationship with the side plates of the casing when the piston assemblies are mounted upon the rotor as will hereinafter be described.

Figure 4:
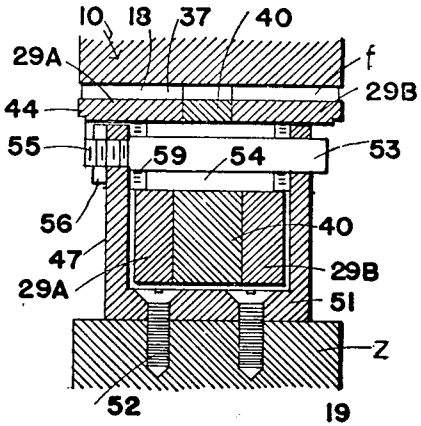
FIG. 4 is a fragmentary section substantially along the line 4—4 of FIG. 2.

All three plates 29A, 29B and 40 are apertured as at 50 for mounting purposes and in this connection reference should be made to FIGS. 2 and 4.

A U-shaped yoke 51 is secured by screws or bolts 52, to the rotor within the cut-out portions 21 and adjacent the stepped shoulder 26, the U-shaped yokes being secured to the radius portion 23.

A pivot pin 53 is provided with a bushing 54 and this pivot pin extends through apertures adjacent the upper ends of the legs 47 of the yoke 51. This pivot pin is provided with a reduced screw threaded end 55 upon which a nut 56 engages so that the position of the pin within the yoke legs 47 can be varied, the purpose of which will hereinafter become apparent.

The plates forming the piston component 28 are mounted upon the bushing 54 and the relationship of the centre plate 40 with the outer plates 29A and 29B is due to the fact that all three plates pivot around this bushing 54 urged by the springs 43 so that the outer surfaces 49 of the outer plates are always in bearing relationship with the inner surfaces of the side plates 11 of the casing.

It will be observed that all three plates are provided with a drilled or formed aperture 57 in the portions which include the radius curve 31. This is to ensure that the centre of mass of the piston is moved to the opposite side of the pivot connection (i.e. towards the side including the contact strip 37) so that when the engine is rotating in the direction of arrow 58, centrifugal force will engage the contact strip 37 with the inner surface of the cylindrical chamber 15.

The aforementioned central plate 40 acts as a tapered circular wedge and movement to the left with reference to FIG. 8, slowly takes place due to side wear so that the piston components gradually expand sideways thus maintaining the contact relationship between the outer planes and the side plates of the casing. As this movement slowly takes place due to side wear, the contact line F of the central plate 40 gradually moves out of line with the contact line F of the outer plates 29A and 29B which under certain circumstances could cause leakage along this transverse seal line. However, the length of the contact line of central plate 40 is rather short and will wear automatically faster so that the contact line remains substantially in alignment. To assist in this regard, the central plate 40 could be manufactured of a softer material than the outer plates 29A and 29B.

Figure 11:
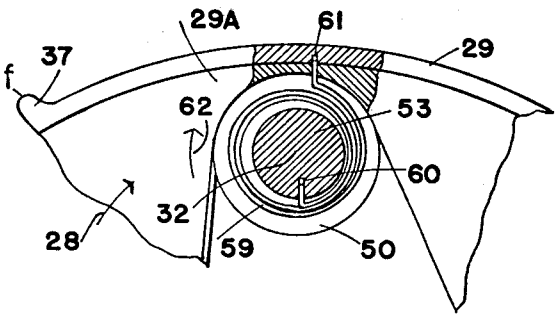
FIG. 11 is an enlarged fragmentary sectional view showing the spring connection between the mounting pin and the piston component.

As well as centrifugal force, further means are provided to maintain the sealing strip 37 (and contact line F) in contact with the inner surface of the annular ring 10 and reference should be made to FIGS. 4 and 11 in this regard.

It will be observed that the bushing 54 around the pin 53 is shorter in length than the distance between the inner surfaces of the legs 47 of the yoke 51 thus defining annular spaces within which a tension coil springs 59 is located extending around the pin 53 and being anchored to the pin by one end thereof within slot 60 as shown in FIG. 11.

The distal end of the spring is anchored within a slot 61 formed in the wall of the aperture 50 of the outer plates 29A and 29B and the tension coil spring is located so that the piston component is urged in the direction of arrow 62 thus forcing the contact strip 37 (and sealing line F) against the wall of the annular ring 10.

An internal hexagonal hole 55A is formed in the screw threaded end 55 of pin 53 so that a tool can be engaged therein. This has the effect of enabling the pin to be rotated to the desired amount in order to tighten the tension spring 59 whereupon it is clamped into position against the legs 47 of the yoke 51 by means of a nut 56.

Figure 6:
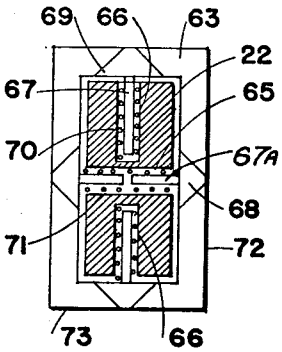
FIG. 6 is a section along the line 6—6 of FIG. 5, but showing the seals in place.

Means are provided to ensure sealing engagement of the rotor arms 22 with the portion of the pistion component bearing thereagainst and also with the side plates 11 of the casing and in this regard, reference should be made to FIGS. 5 and 6.

The aforementioned grooves 27 receive right angled seal pieces 63 and the portion 64 at the base of the grooves 27 is provided with a transverse aperture 65 and blind apertures 66 at right angles thereto.

Pins 67 slide within these apertures and are provided with wedges 68 on the upper ends thereof which engage the chamfered ends 69 of the right angled seal pieces 63 as clearly shown in FIG. 6. Springs 70 engage around the pins 67 and react between the bases of the blind holes 66 and the wedges and a further spring 71 is situated around the pins 67A in the transverse aperture 65 and reacts between the opposing wedges 68.

This forces the seal pieces outwardly and ensures a sealing engagement between the ends 73 of the seal pieces and the inner surfaces of the side plates 11 and between the sides 72 of the seal pieces and the portion of the piston component bearing against the curved sides of the arms 22 of the rotor (FIG. 2 shows the relationship of the seals although only the grooves are shown in FIG. 2 for clarity with the seals being removed). This seal arrangement is self adjusting for wear in the following manner. As wear takes place on outer surfaces 72 and 73 of the right angled seal pieces 63, wedges 68 move further outwards due to springs 70 and 71 and thus bear against the side plates 11 and the piston components 29A, 29B, and 40A. Since the area of the ends of wedges 68 is very small, these ends automatically wear to the correct length and thus are able to maintain seal efficiency over long periods of operation. To assist in this regard the wedge 68 could be manufactured of a softer material than the right angle seals 63.

In the present embodiment, an exhaust port 74 is formed through the wall of the annular ring 10 to the left of top dead centre 75 with reference to FIG. 2.

An intake port 76 is also formed through the wall of the annular ring 10 to the right of top dead centre 75 with reference to FIG. 2.

Figure 3:
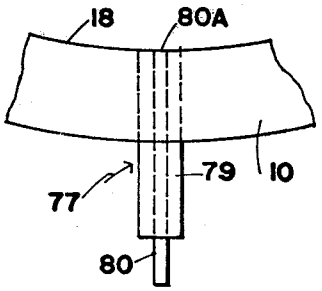
FIG. 3 is an enlarged fragmentary portion of the casing showing one method of providing the desired ignition.

FIG. 3 shows one embodiment of a firing device 77 situated substantially at bottom dead centre 78 with reference to FIG. 2.

This firing device includes an insulated sleeve 79 pressed or screwed into an aperture formed through the annular ring 10 and having a metal electrode 80 pressed or screwed centrally through the insulator 79.

The inner ends of the parts 79 or 80 are machined to the same curvature as the inner surface 18 of the ring 10 and when connected to a conventional ignition device, the spark will jump from the inner end 80A of the part 80, to the part 10.

This assumes that the intake is supplied with a conventional gasoline/air mixture.

However, by increasing the compression ratio of the device, air can be drawn within the intake 76 and fuel injected adjacent bottom dead centre thus converting the engine to a compression ignition device.

In operation, reference should be made to FIG. 2 with the rotor and piston components rotating clockwise or in the direction of arrow 58.

Piston component specifically designated 28B has just passed the intake 76 thus drawing in the fuel/air mixture behind the sealing strip 37 and compressing the fuel/air mixture ahead or clockwise of this sealing strip 37 within the compression chamber 16B.

At the same time, the piston component 28D is on the power or expansion stroke with the fuel/air mixture having been fired and being trapped between sealing strips 37 of piston components 28C and 28D.

Burned gases in advance of the sealing strip 37 of piston component 28D, are being exhausted through the exhaust port 74 and the pistons at bottom and top dead centres 28A and 28C are acting as sealing devices at this particular point.

Going back to piston component specifically designated 28B, the transverse sealing strip 37 is maintained in engagement with the inner surface of the annular ring 10 by the aforementioned tension coil springs 59 and centrifugal force. Furthermore, as the gas/air mixture is being compressed in the compression chamber portion 16B, the strip 37 is further urged into contact with the surface of the ring due to the fact that the pressure of the compression gases has a greater effect on the lower portion of this piston than the upper portion because it has a longer radius from the pivot locus 32.

It should also be observed that the left hand piston 28D is also rotated clockwise by the combustion pressure since the radius to the seal line F is greater than the radius of the portion 30A which is running against the curved wall of the leg 22 of the rotor.

It will therefore be observed that the pressure on either side of the seal line F causes clockwise rotation of the piston to assist in maintaining good seal efficiency.

As the engine rotates it will be observed that there are four pulses per revolution and that the number of pulses is therefore equivalent to an eight cylinder conventional four-stroke engine.

It will be seen that the rocking action of the piston component is controlled by the connection between the transverse contact strips 37 and the contoured inner surface of the annular ring 10 and the aforementioned gas pressure causing the clockwise rotation of the piston components with reference to FIG. 2, is due to the shape of the piston components with the different radius portions defined by radii 30 and 31.

It should be noted that the portion 33 is narrower in cross section than the remainder of the piston component to receive the legs 47 of the yoke 51 which support the piston components for pivotal connection to the rotor 19.

Finally reference should be made to the piston components which are slightly wider around the periphery thereof as compared to the remainder of the components. This is caused by the provision of outwardly extending flange portions 44, 45 and 46 formed on the periphery of the side plates 29A and 29B so that it is only the flanged portions which engage the side plates 11 thus reducing friction yet still maintaining an efficient seal therebetween.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. In a rotary engine which includes intake and exhaust means, fuel supply means and ignition means, said rotary engine comprising in combination a casing, said casing including a pair of spaced and parallel side walls and an annular ring therebetween having an inner surface and defining with said side walls, a substantially cylindrical chamber therewithin, a main shaft journalled for rotation within said side walls and extending transversely and axially through said casing, a rotor component secured to said shaft within said chamber, and a plurality of piston components pivotally mounted to said rotor around the periphery thereof, each of said pistons being in sealing engagement with said side walls and having a transverse contact strip in sealing engagement with the inner surface of said annular ring, said inner surface of said annular ring being contoured to form a compression lobe on one side thereof and an expansion lobe on the other side thereof substantially diametrically opposite to said compression lobe, each of said piston components including a pair of outer plates and an inner plate therebetween, the inner surface of said outer plates and the outer surfaces of said inner plate being inclined whereby engagement of said inner plate between said outer plates constitutes a circular wedging action, spring means operatively connected between said inner plate and said outer plates and means mounting said plates pivotally upon said rotor, said spring means uring rotative movement between said inner plate and said outer plates thereby urging said outer plates apart and into sealing contact with said side walls of said chamber.

2. The device according to claim 1 which includes sealing means between said rotor and said side walls and between said rotor and said pistons.

3. The device according to claim 1 in which said rotor is formed with cut-out portions to receive said piston components.

4. The device according to claim 2 in which said rotor is formed with cut-out portions to receive said piston components.

5. The device according to claim 3 in which the parts of said rotor between adjacent cut-out portions constitute arms on said rotor having a substantially rectangular cross section, an annular groove formed around said arms intermediate the ends thereof, said sealing means being mounted within said grooves and comprising four right angular seal pieces engaging within said groove, drillings formed in said arm at the base of said groove, pins slidable within said drillings and extending upwardly therefrom, wedges on the outer ends of said pins engaging between adjacent ends of adjacent right angle seal pieces and springs around said pins engaging said wedges and urging same outwardly and hence expanding said right angle seal pieces against said side walls of said chamber and against said pistons situated within said cut-out portions.

6. The device according to claim 4 in which the parts of said rotor between adjacent cut-out portions constitute arms on said rotor having a substantially rectangular cross section, an annular groove formed around said arms intermediate the ends thereof, said sealing means being mounted within said grooves and comprising four right angular seal pieces engaging within said groove, drillings formed in said arm at the base of said groove, pins slidable within said drillings and extending upwardly therefrom, wedges on the outer ends of said pins engaging between adjacent ends of adjacent right angle seal pieces and springs around said pins engaging said wedges and urging same outwardly and hence expanding said right angle seal pieces against said side walls of said chamber and against said pistons situated within said cut-out portions.

7. The device according to claim 1 which includes means to urge said pistons to pivot upon said rotor in the same direction as said rotor rotates, said last mentioned means including coil springs operatively connected between said means mounting said plates upon said rotor, and said plates.

8. The device according to claim 2 which includes means to urge said pistons to pivot upon said rotor in the same direction as said rotor rotates, said last mentioned means including coil springs operatively connected between said means mounting said plates upon said rotor, and said plates.

9. The device according to claim 3 which includes means to urge said pistons to pivot upon said rotor in the same direction as said rotor rotates, said last mentioned means including coil springs operatively connected between said means mounting said plates upon said rotor, and said plates.

10. The device according to claim 4 which includes means to urge said pistons to pivot upon said rotor in the same direction as said rotor rotates, said last mentioned means including coil springs operatively connected between said means mounting said plates upon said rotor, and said plates.

11. The device according to claim 5 which includes means to urge said pistons to pivot upon said rotor in the same direction as said rotor rotates, said last mentioned means including coil springs operatively connected between said means mounting said plates upon said rotor, and said plates.

12. The device according to claim 6 which includes means to urge said pistons to pivot upon said rotor in the same direction as said rotor rotates, said last mentioned means including coil springs operatively connected between said means mounting said plates upon said rotor, and said plates.

13. A piston component for a rotary engine which includes a casing, said casing including a pair of spaced and parallel side walls and an annular ring having an inner surface and defining with said side walls, a substantially cylindrical chamber therebetween, a main shaft journalled for rotation within said side walls and extending transversely and axially through said casing and a rotor component secured to said shaft within said chamber; said piston component comprising in combination a pair of outer plates and an inner plate therebetween, the inner surface of said outer plates and the outer surfaces of said inner plate being inclined whereby engagement of said inner plate between said outer plates constitutes a circular wedging action, spring means operatively connected between said inner plate and said outer plates and means mounting said plates pivotally upon said rotor, said spring means urging rotative movement between said inner plate and said outer plates thereby urging said outer plates apart and into sealing contact with said side walls of said chamber.

14. The device according to claim 13 which includes means to urge said pistons to pivot upon said rotor in the same direction as said rotor rotates, said last mentioned means including coil springs operatively connected between said means mounting said plates upon said rotor, and said plates.

15. The device according to claim 13 in which said outer plates each include a shoulder formed on the inner surface thereof, a portion of reduced thickness formed on said inner plate and terminating in a pair of shoulders one upon each side of said portion of reduced thickness, and compression springs reacting between the shoulders of said outer plates and the shoulders of said inner plate.

16. The device according to claim 14 in which said outer plates each include a shoulder formed on the inner surface thereof, a portion of reduced thickness formed on said inner plate and terminating in a pair of shoulders one upon each side of said portion of reduced thickness, and compression springs reacting between the shoulders of said outer plates and the shoulders of said inner plate.

17. The device according to claim 14 in which said piston is mounted upon said rotor component with the centre of mass of said piston being to one side of said means mounting said piston upon said rotor component whereby centrifugal force also assists in pivoting said piston upon said rotor component in the same direction as said rotor component rotates.

18. The device according to claim 1 in which the periphery of the plates are curved when viewed in side elevation and include an arcuately curved outer surface, and differently curved side surfaces extending one from each end of said arcuately curved outer surface, the radii of said curved side surfaces being such that gas pressure acting upon said piston upon each side of said means mounting said plates pivotally upon said rotor component, always urges said piston to pivot in the same direction as said rotor component rotates.

19. The piston according to claim 13 in which the periphery of the plates are curved when viewed in side elevation and include an arcuately curved outer surface, and differently curved side surfaces extending one from each end of said arcuately curved outer surface, the radii of said curved side surfaces being such that gas pressure acting upon said piston upon each side of said means mounting said plates pivotally upon said rotor component, always urges said piston to pivot in the same direction as said rotor component rotates.

* * * * *